US011015492B2

(12) United States Patent
Stretch

(10) Patent No.: US 11,015,492 B2
(45) Date of Patent: May 25, 2021

(54) LOWER TRAVEL DEACTIVATING LASH ADJUSTER WHEN COMBINED WITH TWO-STEP VARIABLE VALVE LIFT ROCKER ARM

(71) Applicant: Dale Arden Stretch, Novi, MI (US)

(72) Inventor: Dale Arden Stretch, Novi, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/800,513

(22) Filed: Feb. 25, 2020

(65) Prior Publication Data

US 2020/0271024 A1 Aug. 27, 2020

(51) Int. Cl.

| | |
|---|---|
| ***F01L 1/18*** | (2006.01) |
| ***F01L 13/00*** | (2006.01) |
| *F01L 1/24* | (2006.01) |

(52) U.S. Cl.

CPC ..... *F01L 13/0021* (2013.01); *F01L 1/181* (2013.01); *F01L 2001/2433* (2013.01); *F01L 2013/001* (2013.01)

(58) Field of Classification Search

CPC ..... F01L 13/0021; F01L 1/181; F01L 2001/2433; F01L 2013/001

See application file for complete search history.

(56) References Cited

U.S. PATENT DOCUMENTS

| | | | | |
|---|---|---|---|---|
| 7,263,956 | B2 * | 9/2007 | Spath | F01L 1/146 123/90.16 |
| 2004/0074459 | A1 | 4/2004 | Hayman et al. | |
| 2004/0103869 | A1 | 6/2004 | Harris | |
| 2006/0102119 | A1 | 5/2006 | Gecim et al. | |
| 2009/0228167 | A1 | 9/2009 | Waters et al. | |

FOREIGN PATENT DOCUMENTS

| | | | |
|---|---|---|---|
| WO | 2005093224 | A1 | 10/2005 |

OTHER PUBLICATIONS

International Search Report and Written Opinion for International Application No. PCT/US2018/047929 dated Nov. 28, 2018.

* cited by examiner

*Primary Examiner* — Zelalem Eshete
(74) *Attorney, Agent, or Firm* — RMCK Law Group PLC

(57) ABSTRACT

A method of operating a rocker arm assembly in a cylinder deactivation mode according to one example of the present disclosure includes providing a two-step variable valve lift rocker arm assembly and a deactivating lash adjuster. Operation of the rocker arm assembly in cylinder deactivation mode is selected. The rocker arm assembly is operated in low-lift mode based on the selection of the cylinder deactivation mode. Subsequent to or concurrently with operating the rocker arm assembly in the low-lit mode, the deactivating lash adjuster is operated in the unlatched mode. A first amount of the total lost motion required for cylinder deactivation mode is accounted for by lost motion of the rocker arm assembly operating in the low-lift mode and a remainder amount of the total lost motion is accounted for by lost motion of the deactivating lash adjuster operating in the unlatched mode.

13 Claims, 9 Drawing Sheets

LOWER TRAVEL DEACTIVATING LASH ADJUSTER WHEN COMBINED WITH TWO-STEP VARIABLE VALVE LIFT ROCKER ARM

CROSS-REFERENCE TO RELATED APPLICATIONS

This application is a continuation of International Application No. PCT/US2018/047929 filed Aug. 24, 2018, which claims priority to U.S. Provisional Application No. 62/550,400 filed on Aug. 25, 2017. The disclosure of the above application is incorporated herein by reference.

FIELD

This application relates generally to rocker arm assemblies and more particularly to a variable valve lift rocker arm assembly and deactivating lash adjuster.

BACKGROUND

A variable valve actuation (VVA) device may be a variable valve lift (VVL) system, a cylinder deactivation (CDA) system or other valve actuation system. Such mechanisms are developed to improve performance, fuel economy, and/or reduce emissions of the engine. Several types of VVA rocker arm assemblies include an inner rocker arm within an outer rocker arm that are biased together with torsion springs. A latch, when in the latched position causes both the inner and outer rocker arms to move as a single unit. When unlatched, the rocker arms are allowed to move independent of each other.

Switching rocker arms allow for control of valve actuation by alternating between two or more states, usually involving multiple arms, such as in inner arm and outer arm. In some circumstances, these arms engage different cam lobes, such as low-lift lobes, high-lift lobes, and no-lift lobes. Mechanisms are required for switching rocker arm modes in a manner suited for operation in internal combustion engines.

Deactivating lash adjusters can be provided on valvetrain for altering a lift profile on an engine valve. For example, a deactivating lash adjuster can be moved between a locked and unlocked position by an actuation device. Actuation devices can be hydraulic, mechanical, electrical or other configurations. An actuation device can move a latch pin between a locked position where a cam can open the engine valve on a standard lift profile and an unlocked position where the engine valve does not open.

SUMMARY

A method of operating a rocker arm assembly in a cylinder deactivation mode according to one example of the present disclosure includes providing a two-step variable valve lift rocker arm assembly and a deactivating lash adjuster. The two-step variable valve lift rocker arm assembly is operable in a (i) low-lift mode having a low-lift valve profile and a (ii) high-lift mode having a high-lift valve profile. The deactivating lash adjuster is operable in a latched mode and an unlatched mode. Operation of the rocker arm assembly in cylinder deactivation mode is selected. The rocker arm assembly is operated in low-lift mode based on the selection of the cylinder deactivation mode. Subsequent to or concurrently with operating the rocker arm assembly in the low-lit mode, the deactivating lash adjuster is operated in the unlatched mode. A first amount of the total lost motion required for cylinder deactivation mode is accounted for by lost motion of the rocker arm assembly operating in the low-lift mode and a remainder amount of the total lost motion is accounted for by lost motion of the deactivating lash adjuster operating in the unlatched mode.

According to additional features, the rocker arm assembly comprises an inner arm, an outer arm that is pivotally coupled to the inner arm, and a latch assembly having a latch. The latch assembly is actuated between a first configuration in the high-lift mode to a second configuration in the low-lift mode. Actuating the latch assembly comprises one of (i) engaging the latch with one of the inner and outer arms such that the outer arm rotates with the inner arm and (ii) disengaging the latch from one of the inner and outer arms such that one of the inner and outer arms rotates independently from the other of the inner and outer arms. The latch translates between an extended position in the high-lift mode and a retracted position in the low-lift mode. The latch assembly can be actuated mechanically, hydraulically, electrically or by other means.

According to other features, operating the deactivating lash adjuster in the unlatched mode comprises retracting an inner portion of the deactivating hydraulic lash adjuster within an outer portion of the deactivating hydraulic lash adjuster with an actuation device. The inner portion of the hydraulic lash adjuster can be retracted hydraulically, mechanically electrically or by other means. Retracting an inner portion of the deactivating lash adjuster comprises collapsing diametrically opposed pins from an engaged position with an annular groove defined in the outer portion of the deactivating hydraulic lash adjuster.

A system for operating a rocker arm assembly in a cylinder deactivation mode according to one example of the present disclosure include a two-step variable valve lift rocker arm assembly, a deactivating lash adjuster and a controller. The rocker arm assembly is operable in a (i) low-lift mode having a low-lift valve profile and a (ii) high-lift mode having a high-lift valve profile. The deactivating lash adjuster is operable in a latched mode and an unlatched mode. The controller (i) selects operation of the rocker arm assembly in the cylinder deactivation mode, (ii) operates the rocker arm assembly in the low-lift mode based on the selection of the cylinder deactivation mode, and (iii) one of subsequent to or concurrently with operating the rocker arm assembly in the low-lift mode, operating the deactivating lash adjuster in the unlatched mode. A first amount of a total lost motion required for cylinder deactivation mode is accounted for by lost motion of the rocker arm assembly operating in the low-lift mode and a remainder amount of the total lost motion is accounted for by lost motion of the deactivating lash adjuster operating in the unlatched mode.

In other features, the rocker arm assembly comprises an inner arm, an outer arm that is pivotally coupled to the inner arm, and a latch assembly having a latch and wherein the latch is actuated between a first configuration in the high-lift mode to a second configuration in the low-lift mode. The latch is engaged with one of the inner and outer arms such that the outer arm rotates with the inner arm in the high-lift mode. The latch is disengaged from one of the inner and outer arms such that one of the inner and outer arms rotates independently from the other of the inner and outer arms in the low-lift mode. The latch can actuate mechanically, hydraulically, electrically or by other means.

According to additional features, the deactivating lash adjuster is a two-position lash adjuster that moves between a first position wherein the lash adjuster is locked and a second position where the lash adjuster is unlocked. The deactivating lash adjuster includes an inner portion that extends at least partially outwardly relative to an outer portion in the first position to a location where latch pins are biased outwardly by a biasing member to a position engaged to an annular notch defined in the outer portion.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

It will be appreciated that the illustrated boundaries of elements in the drawings represent only one example of the boundaries. One of ordinary skill in the art will appreciate that a single element may be designed as multiple elements or that multiple elements may be designed as a single element. An element shown as an internal feature may be implemented as an external feature and vice versa.

Further, in the accompanying drawings and description that follow, like parts are indicated throughout the drawings and description with the same reference numerals, respectively. The figures may not be drawn to scale and the proportions of certain parts have been exaggerated for convenience of illustration.

DETAILED DESCRIPTION

Figure 1A:
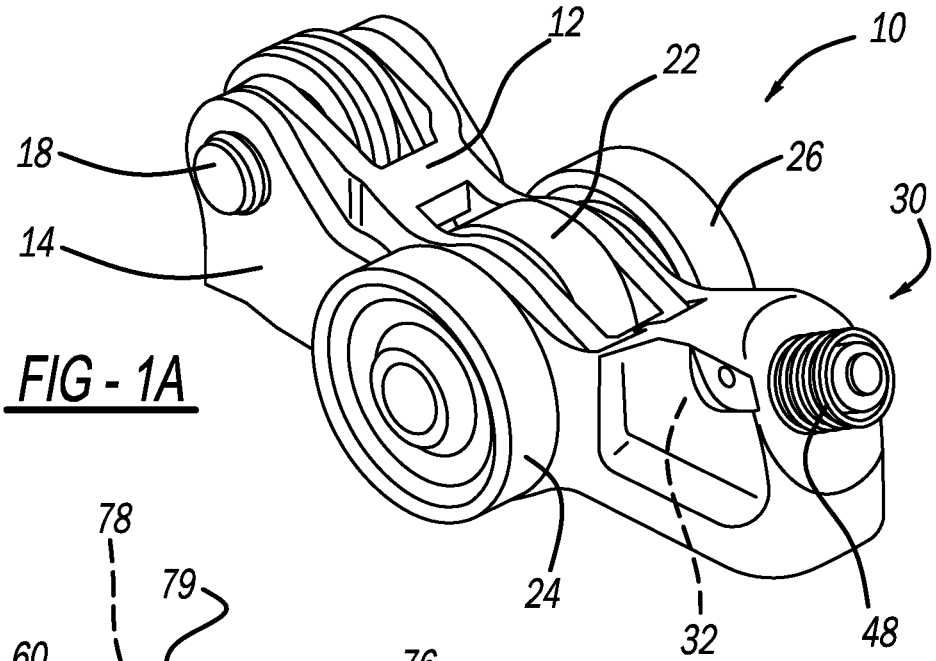
FIG. 1A is a perspective view of an exemplary two-step VVL rocker arm assembly constructed in accordance to one example of prior art.

Certain terminology will be used in the following description for convenience in describing the figures will not be limiting. The terms "upward," "downward," and other directional terms used herein will be understood to have their normal meanings and will refer to those directions as the drawing figures are normally viewed.

As will become appreciated from the following discussion, the present teachings provide a rocker arm assembly and deactivating lash adjuster combination and related method for operating the rocker arm assembly and deactivating lash adjuster that allows for a reduced size lash adjuster. Conventional deactivating lash adjusters can be quite large in part because of the long length of travel needed to have lost motion for full cam lift. The present teachings combine a two-step variable valve lift (VVL) rocker arm with a deactivating lash adjuster. A related control method is provided that deactivates the engine valve by setting the rocker arm to a low-lift mode and concurrently or subsequently unlatching the deactivating lash adjuster. In this regard, a control strategy for cylinder deactivation includes operating the VVL rocker arm on a low-lift profile when the valve is in deactivation mode. The strategy will require a smaller cylinder deactivating lash adjuster which would require reduced packaging space for the deactivating lash adjuster allowing for a smaller, reduced cost deactivating lash adjuster.

The instant disclosure provides improved packaging of a deactivating lash adjuster while providing three VVA options (high lift, low lift and deactivation). The smaller package will allow for more applications of the technology. As used herein the term "high-lift" is used to denote a valve lift that is greater in travel than a "low-lift". For example, a high-lift can be a normal or extended valve lift event, while the low lift event is shorter. So, the high-lift event can provide, for example, Late Intake Valve Closing (LIVC) or Normal Intake Valve Closing, while the low-lift event can provide Early Intake Valve Closing (EIVC).

Figure 1B:
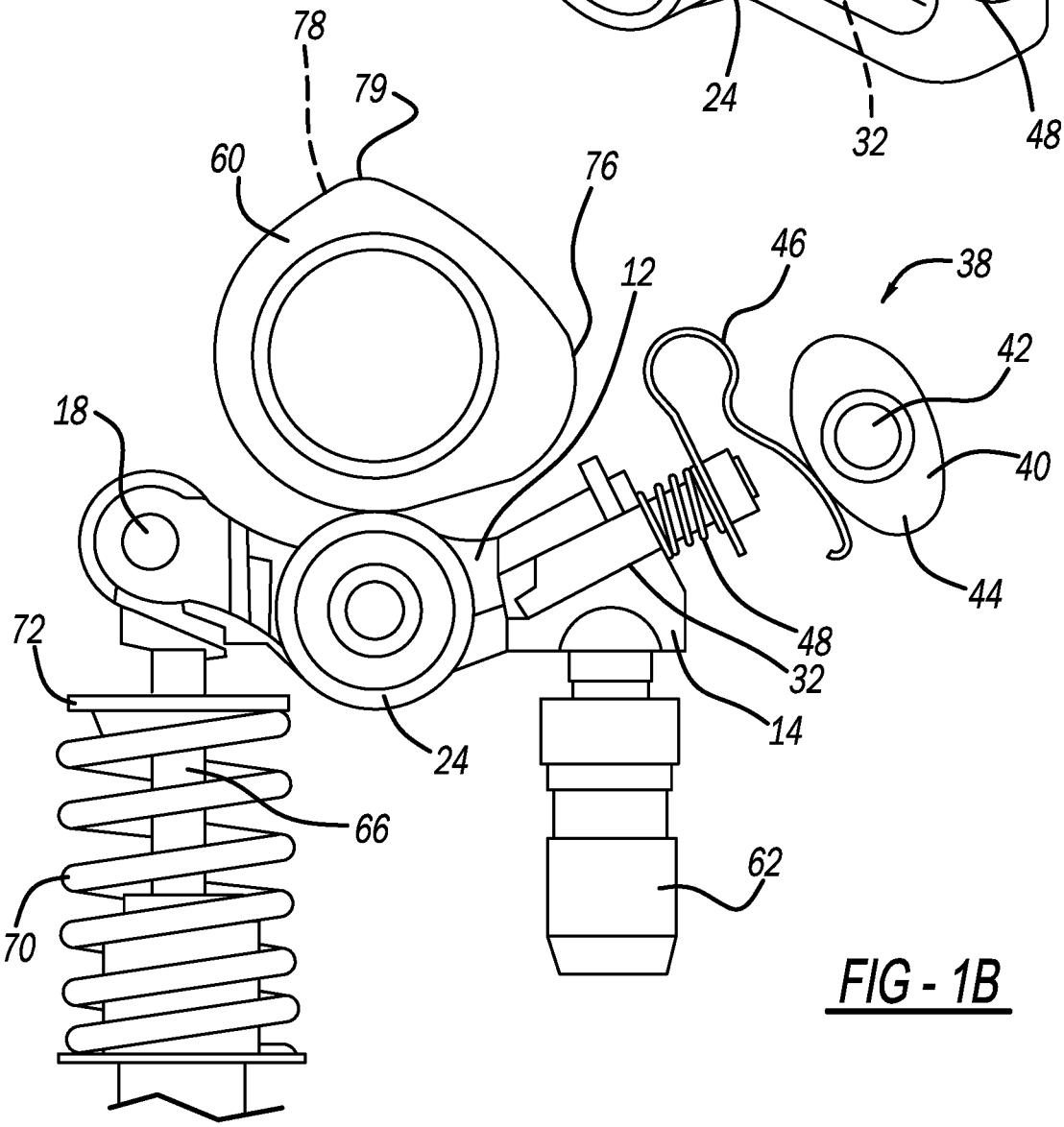
FIG. 1B is a partial sectional view of the rocker arm assembly of FIG. 1A and shown with an exemplary engine valve and lash adjuster, the rocker arm assembly having a latch assembly including a latch pin shown in an unlatched position.
Figure 1C:
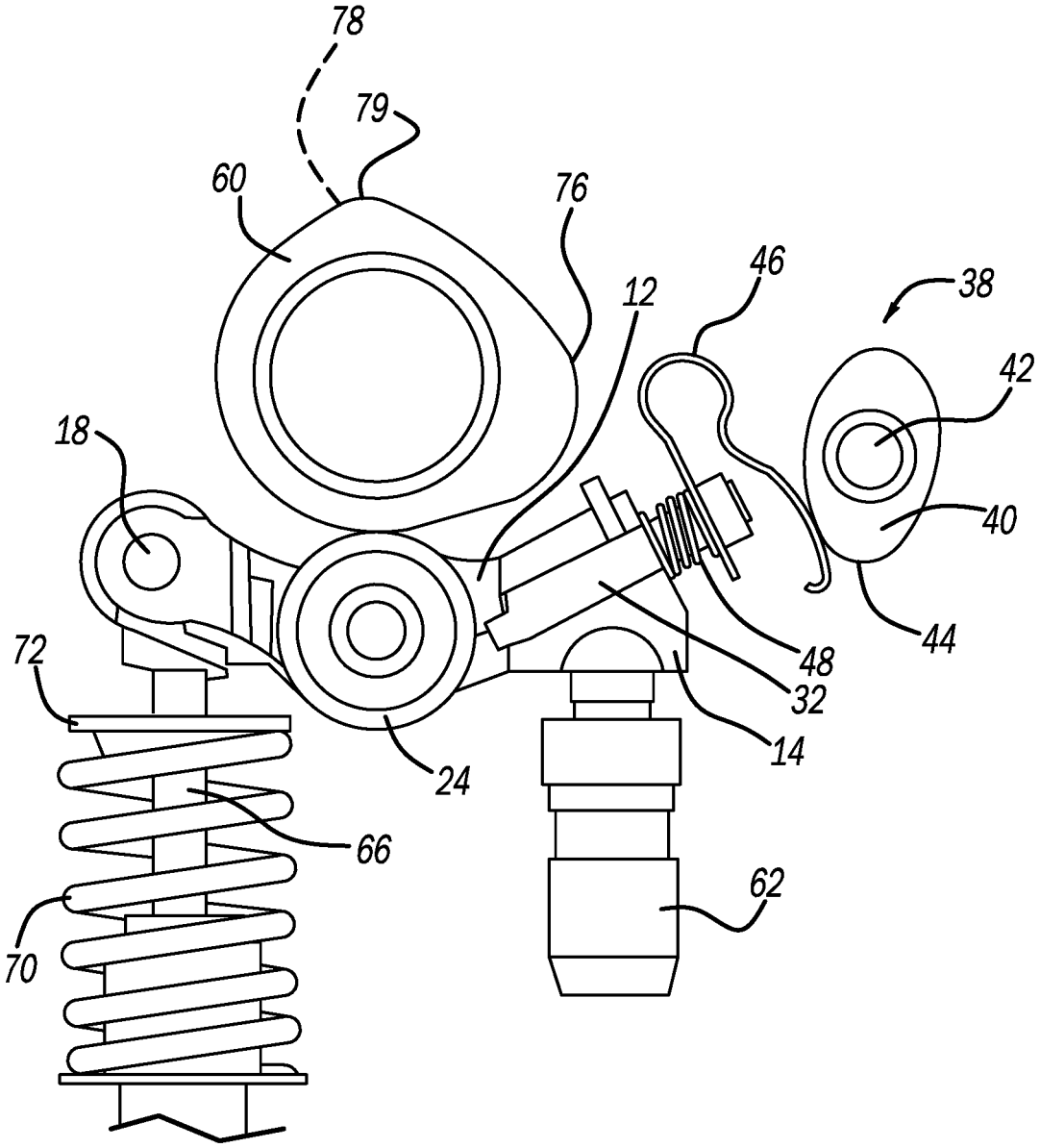
FIG. 1C is a partial sectional view of the rocker arm assembly of FIG. 1B and shown with the latch pin in a latched position.

With initial reference now to FIGS. 1A and 1B, an exemplary rocker arm assembly constructed in accordance to one example of the present disclosure is shown and generally identified at reference 10. The rocker arm assembly 10 includes an inner arm 12 and an outer arm 14. The inner and outer arms 12 and 14 are pivotally coupled to each other at a pivot axle 18. The rocker arm assembly 10 incorporates a three roller configuration including an inner roller 22 provided on the inner rocker arm 12 and outer rollers 24 and 26 arranged on the outer rocker arm 14. A latch assembly 30 is movable between a first configuration in a high-lift mode and a second configuration in a low-lift mode. In the high-lift mode, a latch pin 32 is translated to an engaged (latched, FIG. 1C) position with the inner arm 12 whereby the inner and outer arms rotate together. In a low-lift mode, the latch pin 32 is retracted to a disengaged (unlatched, FIG. 1B) position with the inner arm 12 whereby the inner and outer arms 12 and 14 rotate independently.

In the example shown, the latch pin 32 can be urged into the latched position by a latch actuation device 38. The latch actuation device 38 shown in FIG. 1B includes a selector cam 40 arranged on an auxiliary cam shaft 42. The auxiliary cam shaft 42 can be rotated by any suitable means such as an electric motor for example. Rotation of the selector cam 40 causes a selector cam lobe 44 to compress a compliance spring 46 and thereby translate the latch pin 32 leftward as viewed in FIG. 1B. A return spring 48 normally biases the latch pin 32 to the unlatched position when the selector cam lobe 44 is not directed onto the compliance spring 46.

Figure 2:
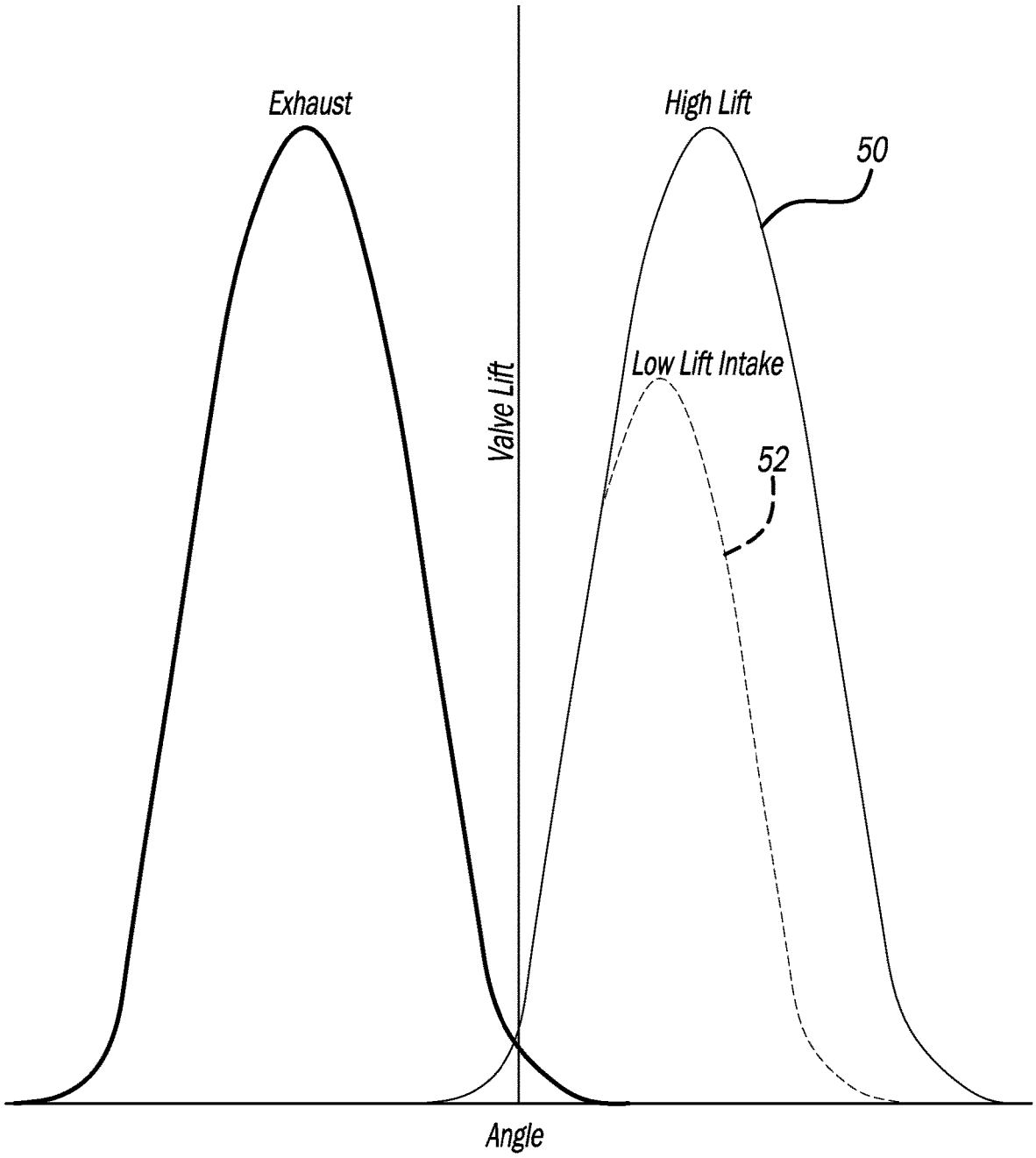
FIG. 2 is an exemplary plot illustrating valve lift versus cam angle for the rocker arm of FIG. 1A showing high lift (solid line) when the latch is in a locked position and a low lift (dashed line) when the latch is in an unlocked position according to one example of prior art.

With particular reference now to FIG. 1B and 2, when the rocker arm assembly 10 is latched, the cam 60 will open the engine valve 66 on high-lift 50 (FIG. 2). When the rocker arm assembly 10 is unlatched, the cam 60 will open the engine valve 66 on low-lift 52 (FIG. 2). The rocker arm assembly 10 is shown configured for operation with a three lobed cam 60, a lash adjuster 62, a valve 66, a valve spring 70 and a spring retainer 72. The cam 60 has a high-lift lobe 76 and a first and second low lift lobe 78, 79.

During the high-lift mode, the high-lift lobe 76 contacts the inner roller 22 on the inner arm 12. In the high-lift mode, the outer arm 14 is latched to the inner arm 12 by the latch pin 32. During engine operation, the high-lift lobe 76 periodically pushes the inner arm 12 downward. Because the inner arm 12 is latched to the outer arm 14, the high-lift motion is transferred to the valve 66. When the rocker arm 10 is in low-lift mode, the outer arm 14 is not latched to the inner arm 12, and so high-lift movement exhibited by the inner arm 12 is not transferred to the valve 66. Instead, the low-lift lobes 78 and 79 contact the rollers 24, 26 on the inner arm 12 and generates low-lift motion that is transferred to the valve 66.

It will be appreciated that the rocker arm assembly 10 is merely exemplary and that other rocker arm assemblies that switch between a high-lift mode and a low-lift mode may be used in conjunction with the present disclosure. For example, one suitable switching rocker arm assembly is disclosed in U.S. Pat. No. 9,790,823 assigned to Eaton Corporation, the contents of which are expressly incorporated herein by reference. It will further be appreciated that the latch pin 32 may be actuated by any suitable mechanical, hydraulic and/or electrical device. One suitable configuration is disclosed in U.S. Patent Publication 2017/0198613 assigned to Eaton SRL, the contents of which are expressly incorporated herein by reference.

Figure 3A:
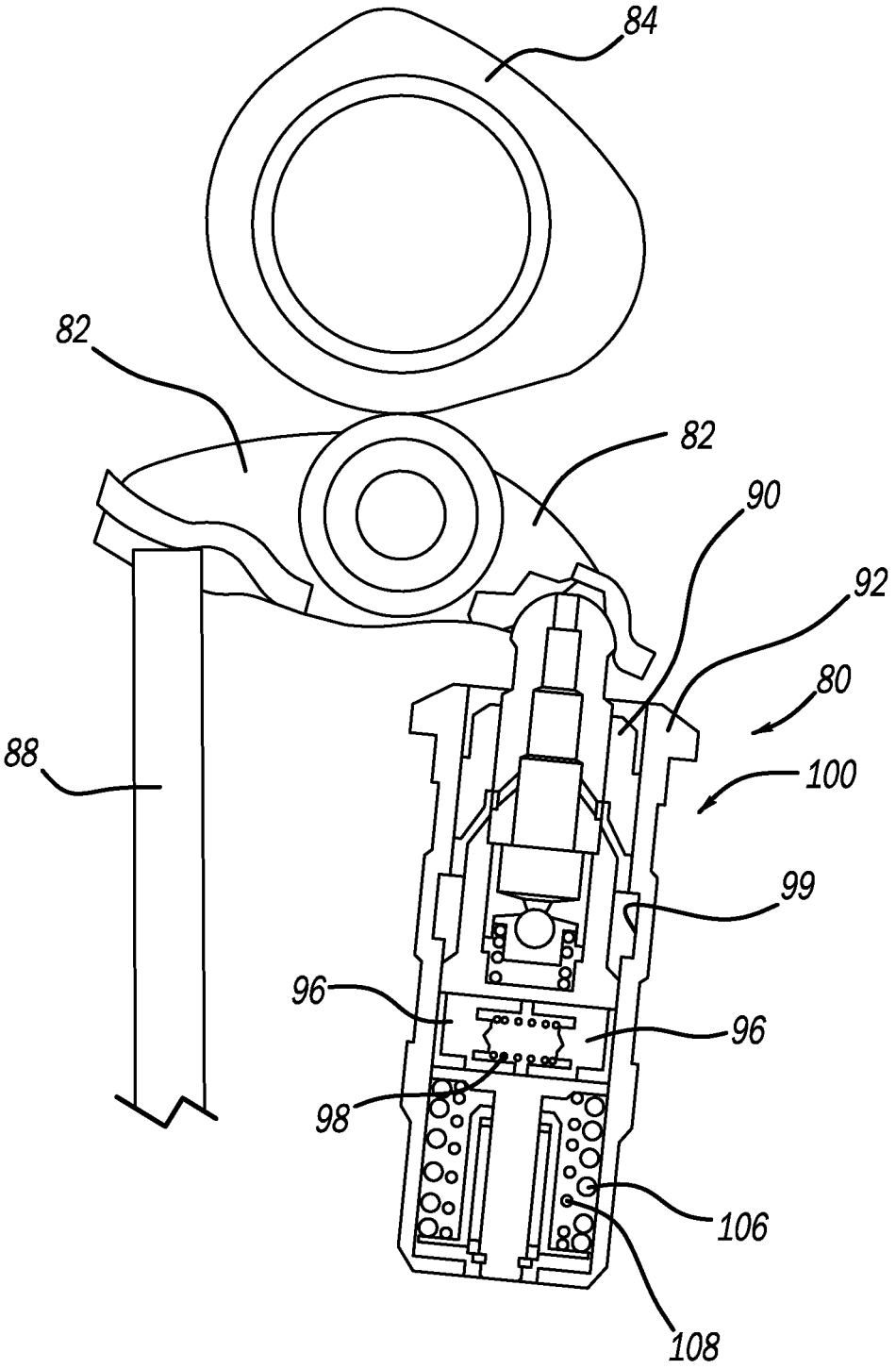
FIG. 3A is a partial sectional view of a two-position lash adjuster used in a deactivation rocker arm assembly according to one example of prior art, the two-cylinder position lash adjuster shown in a first unlatched (unlocked) position.
Figure 3B:
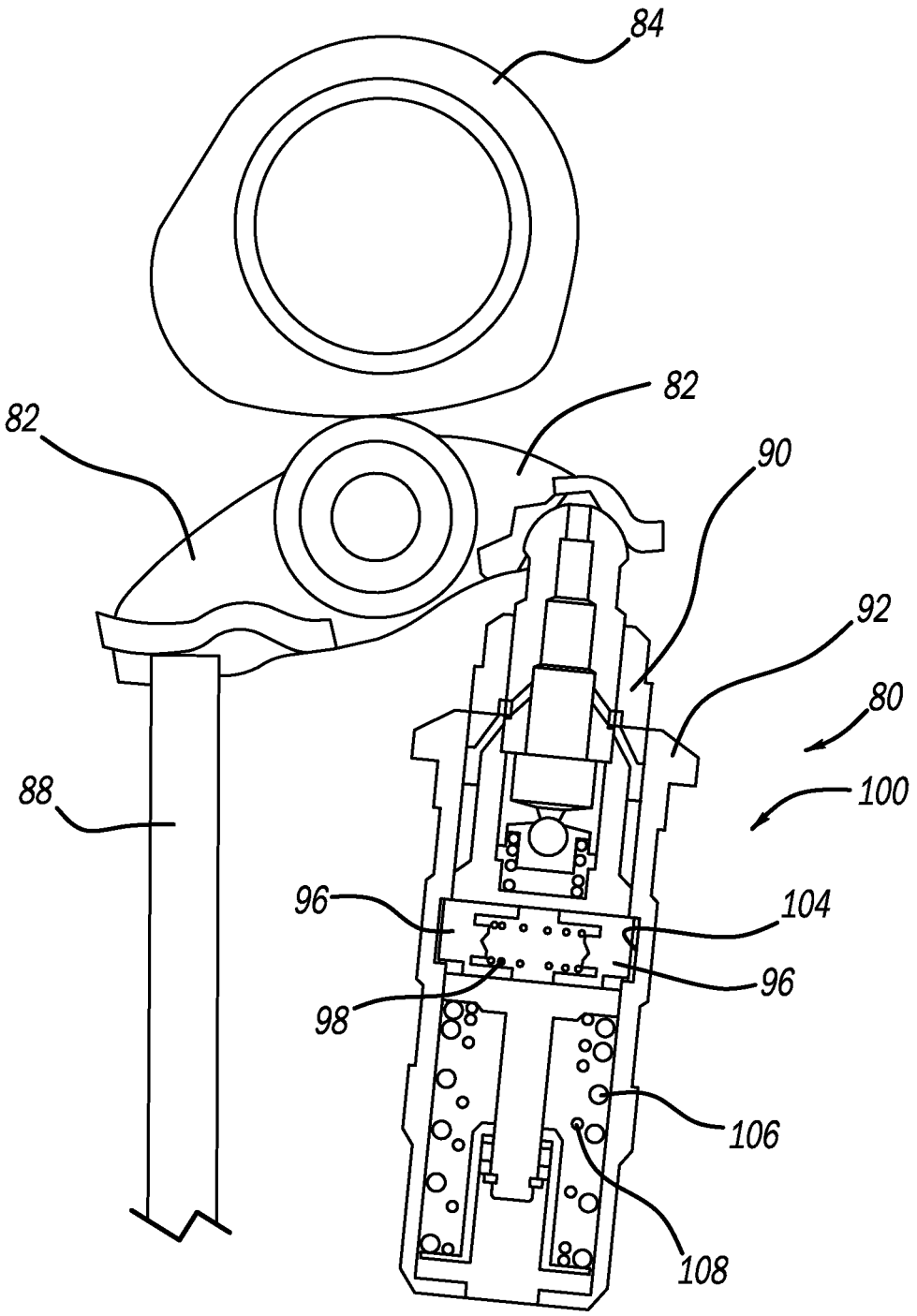
FIG. 3B is a partial sectional view of the two-position lash adjuster of FIG. 3A shown in a second latched (locked) position.

With reference now to FIGS. 3A and 3B, an exemplary deactivating lash adjuster according to one example of the present disclosure is shown and generally identified at reference 80. The deactivating lash adjuster 80 is shown with an exemplary rocker arm 82 that moves in response to contact by a rotating cam 84. Movement of the rocker arm 82 causes a valve 88 to open and close. The exemplary deactivating lash adjuster 80 is configured to move between an unlatched mode (FIG. 3A) and a latched mode (FIG. 3B). In the unlatched mode, an inner portion 90 is retracted within an outer portion 92 such that diametrically opposed latch pins 96 are retracted against the bias of a biasing member 98. In the latched mode, the inner portion 90 extends at least partially outwardly relative to the outer portion 92 to a location where the latch pins 96 are biased outwardly by the biasing member 98 to a position engaged to an annular notch 99 defined in the outer portion 92. Biasing members 106 and 108 can further encourage the inner portion 90 to move outwardly relative to the outer portion 92.

Figure 4:
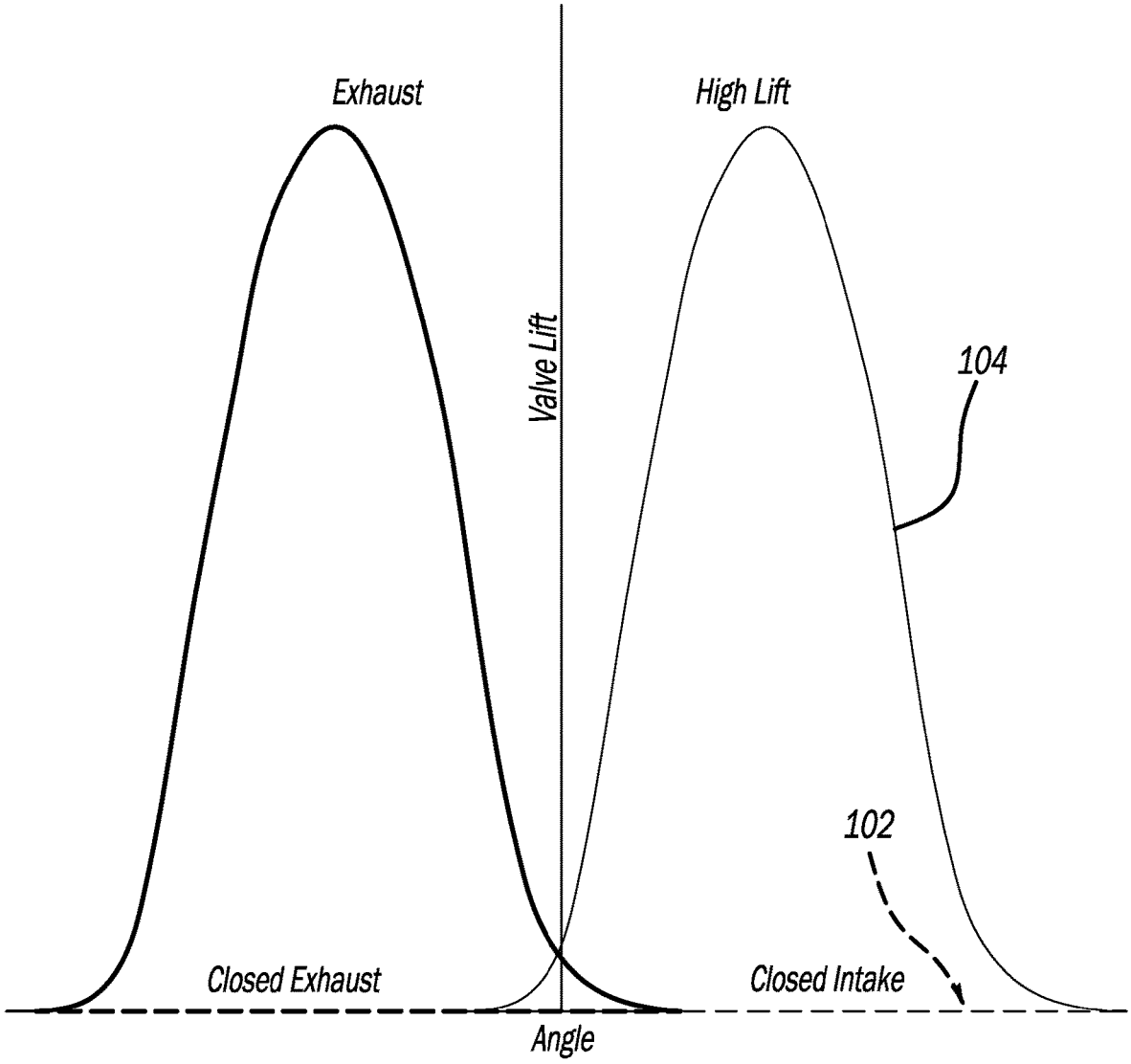
FIG. 4 is an exemplary plot illustrating valve lift versus cam angle for the rocker arm configuration of FIGS. 3A and 3B.

The deactivating lash adjuster 80 is a two-position lash adjuster that moves between a first position where the lash adjuster 80 is locked (FIG. 3B) and a second position where the lash adjuster 80 is unlocked (FIG. 3A). The two-position lash adjuster 80 can move between the locked and unlocked position from an actuation device 100. The actuation device 100 acts on the latch pin 96. In the unlocked position, the engine valve 88 follows plot 102 (FIG. 4) does not open. When the lash adjuster is locked (FIG. 3B), the cam 84 will open the engine valve 88 on its standard lift profile 104 (FIG. 4).

The configuration shown in FIGS. 3A and 3B using the deactivating lash adjuster 80, the deactivating lash adjuster 80 can require travel equivalent of full valve lift. This means that the deactivating lash adjuster 80 has to account for a significant amount of lost motion to accommodate the full valve lift. In many applications, a deactivating lash adjuster having such large size and cost needed to account for the lost motion can be an impediment to use.

It will be appreciated that the deactivating lash adjuster 80 shown in FIGS. 3A and 3B is merely exemplary and that other deactivating lash adjusters may be shown to emphasize the amount of lost motion needed to accommodate full valve lift. Such deactivating lash adjusters can use an actuation device 100 that is any combination of hydraulic, mechanical and electrical in nature.

Figure 5:
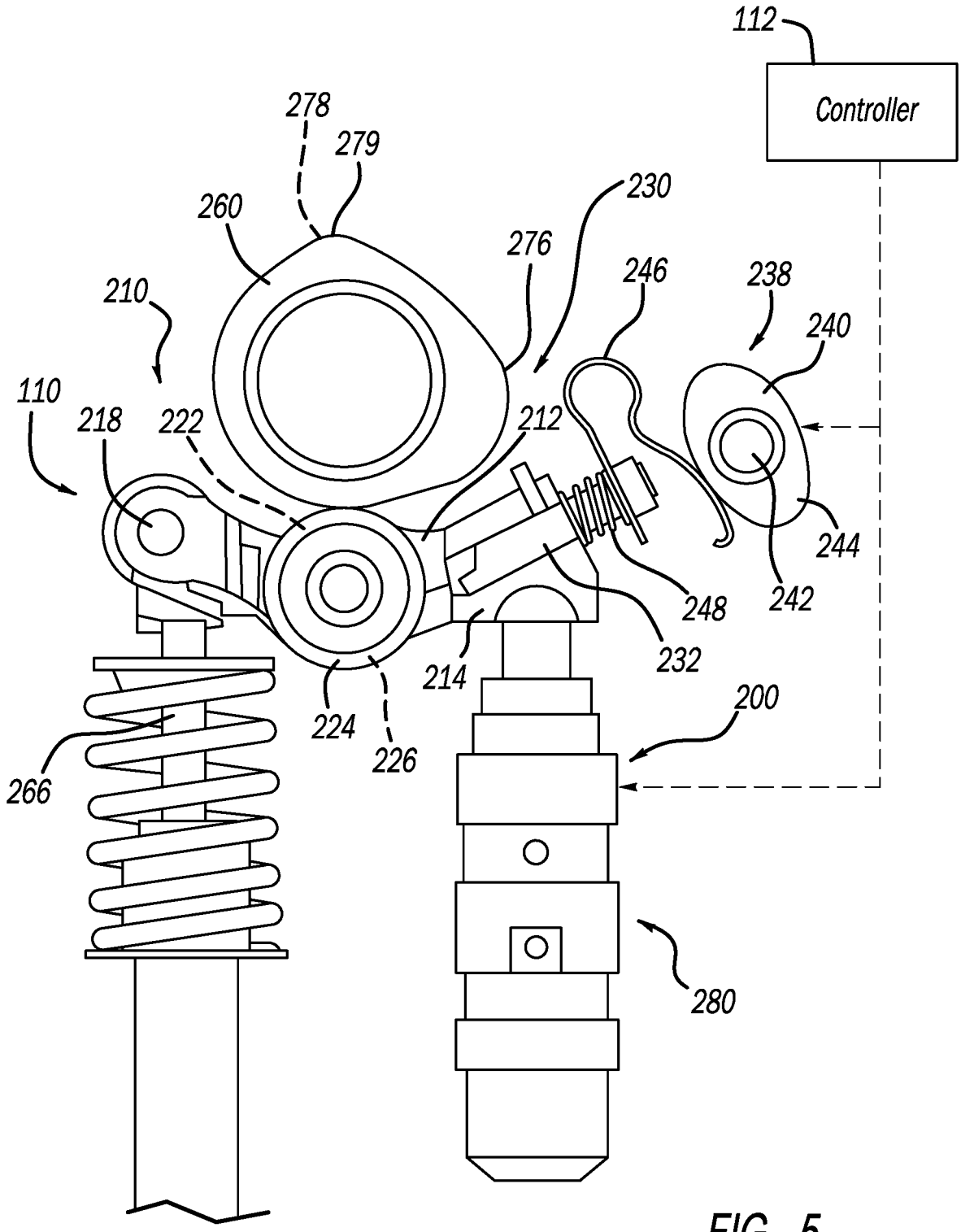
FIG. 5 is a partial schematic view of a system for operating a rocker arm assembly in a cylinder deactivation mode including a partial sectional view of a rocker arm assembly and deactivating lash adjuster constructed in accordance to one example of the present disclosure and shown with an exemplary engine valve.
Figure 6:
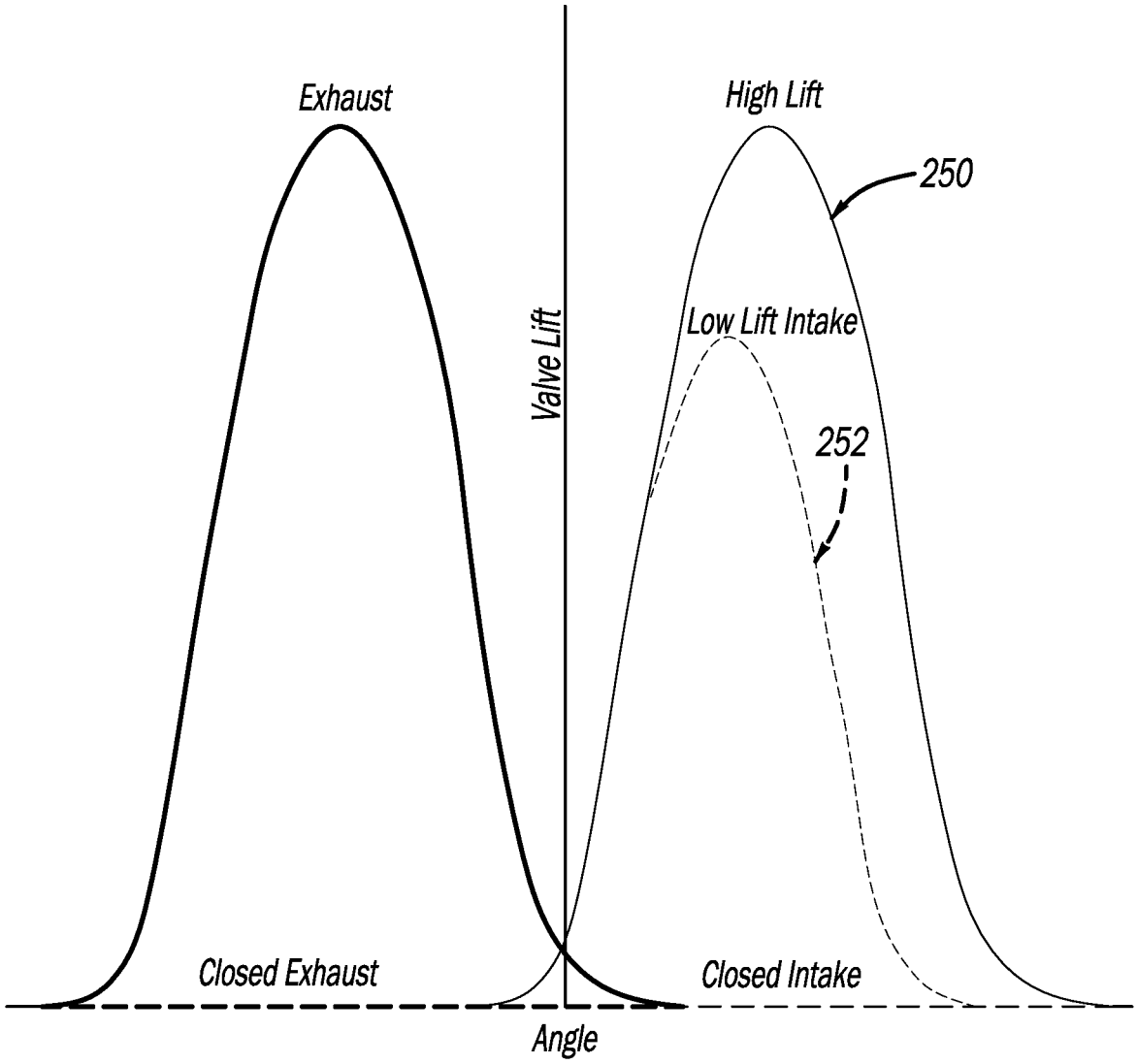
FIG. 6 is an exemplary plot illustrating valve lift versus cam angle for the system and rocker arm configuration of FIG. 5.
Figure 7:
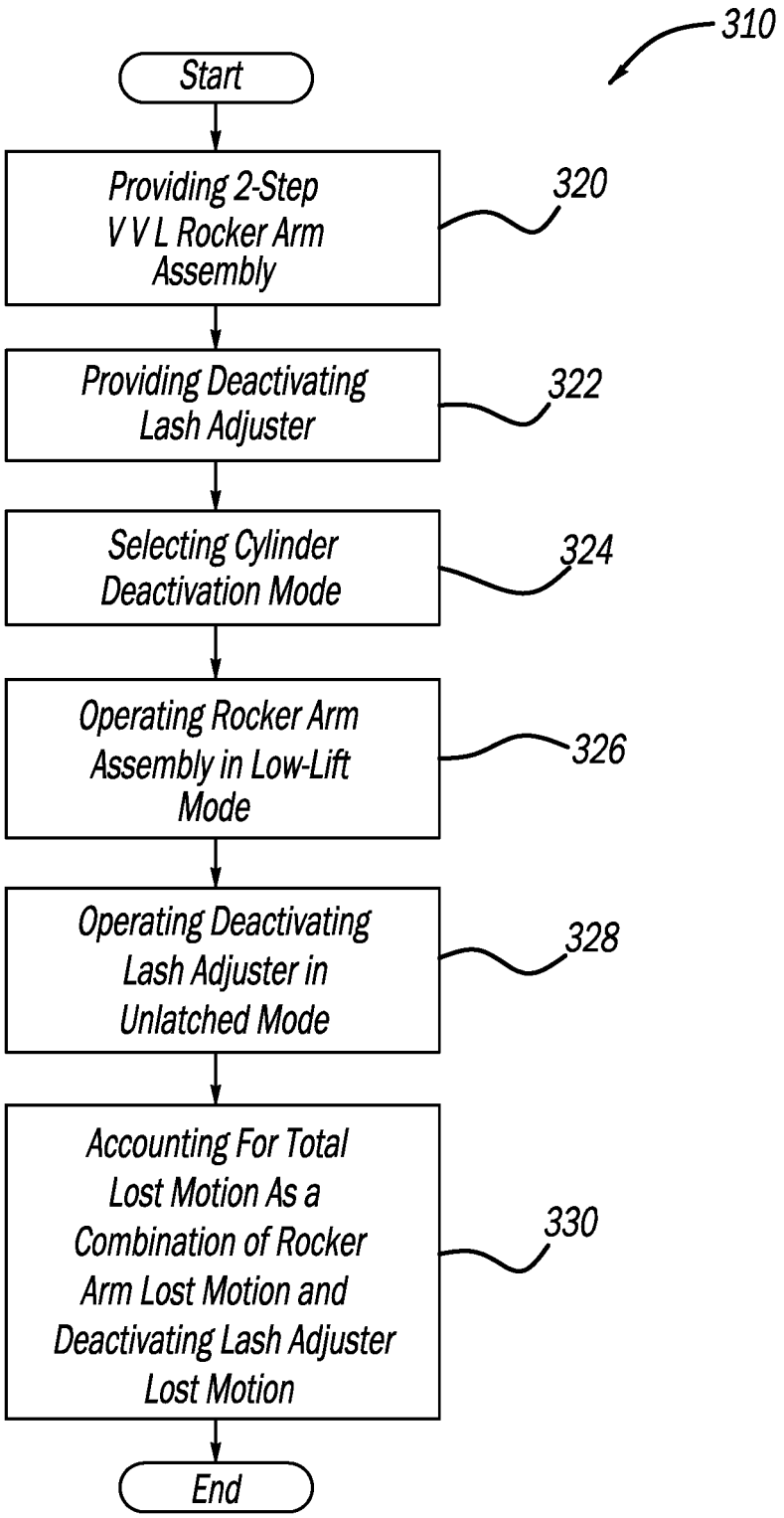
FIG. 7 is a method of operating a deactivating lash adjuster with a two-step VVL rocker arm according to one example of the present disclosure.

With reference now to FIGS. 5-7, a system 110 for operating a rocker arm assembly 210 and a deactivating lash adjuster 280 according to one example of the present disclosure will be described. The system 110 comprises a controller 112 that selectively communicates with a latch actuation device 238 of the rocker arm assembly 210 and an actuation device 200 of the deactivating lash adjuster 280. The combination rocker arm assembly 210 and deactivating lash adjuster 280 provides three VVA options including high lift, low lift and cylinder deactivation. The method disclosed herein comprise adjusting the control strategy for deactivation so that the VVL rocker arm assembly 210 is operating on a low lift profile 252 for when the valve 266 is in cylinder deactivation mode. The strategy and method disclosed herein will require a smaller cylinder deactivating lash adjuster 280 (as compared to the deactivating lash adjuster 80, FIG. 3A) which would give a better packaging structure at a lower cost.

The rocker arm assembly 210 will be further described. The rocker arm assembly 210 includes an inner arm 212 and an outer arm 214. The inner and outer arms 212 and 214 are pivotally coupled to each other at a pivot axle 218. The rocker arm assembly 210 incorporates a three roller configuration including an inner roller 222 provided on the inner rocker arm 212 and outer rollers 224 and 226 arranged on the outer rocker arm 214. A latch assembly 230 is movable between a first configuration in a high-lift mode and a second configuration in a low-lift mode. In the high-lift mode, a latch pin 232 is translated to an engaged (latched) position with the inner arm 212 whereby the inner and outer arms 212, 214 rotate together. In a low-lift mode, the latch pin 232 is retracted to a disengaged (unlatched) position with the inner arm 212 whereby the inner and outer arms 212 and 214 rotate independently.

In the example shown, the latch pin 232 can be urged into the latched position by a latch actuation device 238. The latch actuation device 238 shown in FIG. 5 includes a selector cam 240 arranged on an auxiliary cam shaft 242. The auxiliary cam shaft 242 can be rotated by any suitable means such as an electric motor for example. Rotation of the selector cam 240 causes a selector cam lobe 244 to compress a compliance spring 246 and thereby translate the latch pin 232 leftward as viewed in FIG. 5. A return spring 248 normally biases the latch pin 232 to the unlatched position when the selector cam lobe 244 is not directed onto the compliance spring 246.

With particular reference now to FIGS. 5 and 6, when the rocker arm assembly 210 is latched, the cam 260 will open the engine valve 266 on high-lift 250 (FIG. 6). When the rocker arm assembly 210 is unlatched, the cam 260 will open the engine valve 266 on low-lift 252 (FIG. 6). The rocker arm assembly 210 is shown configured for operation with a three lobed cam 260, the lash adjuster 280, a valve 266, a valve spring 270 and a spring retainer 272. The cam 260 has a high-lift lobe 276 and a first and second low lift lobe 278, 279.

During the high-lift mode, the high-lift lobe 276 contacts the inner roller 222 on the inner arm 212. In the high-lift mode, the outer arm 214 is latched to the inner arm 212 by the latch pin 232. During engine operation, the high-lift lobe 276 periodically pushes the inner arm 212 downward. Because the inner arm 212 is latched to the outer arm 214, the high-lift motion is transferred to the valve 266. When the rocker arm assembly 210 is in low-lift mode, the outer arm 214 is not latched to the inner arm 212, and so high-lift movement exhibited by the inner arm 212 is not transferred to the valve 266. Instead, the low-lift lobes 278 and 279 contact the rollers 224, 226 on the outer arm 214 and generates low-lift motion that is transferred to the valve 266.

The strategy for deactivation, when starting from a high-valve lift mode can be stepwise to first unlatch the rocker arm assembly 110 to put the valve into low-lift mode then, second, unlatch the deactivating lash adjuster 280. If the lash adjuster 280 is put into the unlatched mode first, this may cause the valve to hit its seat prematurely. In one example it is possible to simultaneously unlatch both the rocker arm assembly 110 and the deactivating lash adjuster 280. By entering a deactivated condition during the low-lift event, less travel is required of the deactivating capsule (see inner portion 90, FIG. 3A), thus shortening it and reducing the overall size of the package.

The controller 112 can communicate with the latch actuation device 238 of the rocker arm assembly 210 and the actuation device 200 of the deactivating lash adjuster 280. The actuation device 200 can be any combination of hydraulic, mechanical, electrical or other means for moving the inner portion (see inner portion 90, FIG. 3A) of the deactivating lash adjuster 280 between the unlatched retracted position (see FIG. 3A) and the latched extended position (See FIG. 3B).

The valve 266 can be operated in high-lift mode or low-lift mode under any condition while the lash adjuster is in activation status. The controller 112 can comprise processors, memory devices and/or algorithms stored in memory devices. Appropriate circuitry and fluid handling is also provided. As mentioned above, other latch and unlatch mechanisms can be substituted on the rocker arm assembly 110. For example, the rocker arm assembly 110 can comprise electronic latching mechanisms instead of the mechanical latches shown. Hydraulic latching mechanisms can be used. The orientation of the inner and outer arms 212, 214 and the use of the respective rollers 222, 224 and 226 are exemplary. Other rocker arms, such as those using one or more slider pads can be used, or those using other spring or roller configurations, for example.

A deactivating capsule can be used for converting between the active lift status and the deactivated lift status. The deactivated lift status can mean that the affiliated valve does not open and close, while the active lift status comprises valve opening and closing. The deactivating capsule can be integrally formed with a hydraulic lash adjuster. As drawn, separate oil feeds linked to controllers (such as controller 112) can lead to the lash adjustment portion and to the deactivating capsule portion. It is also contemplated that a single hydraulic system having appropriate valving configurations can be used to control both of the latch actuation device 238 of the rocker arm assembly 210 and the actuation device 200 of the deactivating lash adjuster 280.

With reference now to FIG. 7, an exemplary method of operating a rocker arm assembly in a cylinder deactivation mode is shown and generally identified at reference 310. A two-step variable valve lift rocker arm assembly 210 is provided at 320. A deactivating lash adjuster 280 is provided at 322. Control selects cylinder deactivation at 324. The rocker arm assembly 210 is operated in a low-lift mode at 326. The deactivating lash adjuster 280 is operated in the unlatched mode at 328. The total lost motion is accounted for as a combination of rocker arm lost motion and deactivating last adjuster lost motion at 330. In this regard, a first amount of total lost motion required for cylinder deactivation mode is accounted for by lost motion of the rocker arm assembly 110 operating in the low-lift mode and a remainder amount of the total lost motion is accounted for by lost motion of the deactivating lash adjuster 280 operating in the unlatched mode.

For the purposes of this disclosure and unless otherwise specified, "a" or "an" means "one or more." To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or multiple components. As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term. From about X to Y is intended to mean from about X to about Y, where X and Y are the specified values.

While the present disclosure illustrates various embodiments, and while these embodiments have been described in some detail, it is not the intention of the applicant to restrict or in any way limit the scope of the claimed invention to such detail. Additional advantages and modifications will readily appear to those skilled in the art. Therefore, the invention, in its broader aspects, is not limited to the specific details and illustrative examples shown and described. Accordingly, departures may be made from such details without departing from the spirit or scope of the applicant's claimed invention. Moreover, the foregoing embodiments are illustrative, and no single feature or element is essential to all possible combinations that may be claimed in this or a later application.

What is claimed is:

1. A method of operating a rocker arm assembly in a cylinder deactivation mode, the method comprising:

providing a two-step variable valve lift rocker arm assembly operable in a (i) low-lift mode having a low-lift valve profile and a (ii) high-lift mode having a high-lift valve profile, wherein the rocker arm assembly comprises an inner arm, an outer arm that is pivotally coupled to the inner arm, and a latch assembly having a latch;

providing a deactivating lash adjuster operable in a latched mode and an unlatched mode;

selecting operation of the rocker arm assembly in the cylinder deactivation mode;

actuating the latch assembly between a first configuration in the high-lift mode to a second configuration in the low-lift mode by mechanically actuating the latch based on the selection of the cylinder deactivation mode;

subsequent to operating the rocker arm assembly in the low-lift mode, operating the deactivating lash adjuster in the unlatched mode; and wherein a first amount of a total lost motion required for cylinder deactivation mode is accounted for by lost motion of the rocker arm assembly operating in the low-lift mode and a remainder amount of the total lost motion is accounted for by lost motion of the deactivating lash adjuster operating in the unlatched mode.

2. The method of claim 1, wherein actuating the latch assembly further comprises:

one of (i) engaging the latch with one of the inner and outer arms such that the outer arm rotates with the inner arm, and (ii) disengaging the latch from one of the inner and outer arms such that one of the inner and outer arms rotates independently from the other of the inner and outer arms.

3. The method of claim 1 wherein the latch mechanically translates between an extended position in the high-lift mode and a retracted position in the low-lift mode by way of an auxiliary cam shaft that is rotated by a motor, the auxiliary cam shaft causing a selector cam lobe to compress a compliance spring and thereby translate the latch pin.

4. The method of claim 1 wherein operating the deactivating lash adjuster in the unlatched mode further comprises:

retracting an inner portion of the deactivating hydraulic lash adjuster within an outer portion of the deactivating hydraulic lash adjuster with an actuation device.

5. The method of claim 4 wherein the inner portion of the hydraulic lash adjuster is retracted hydraulically.

6. The method of claim 5 wherein the inner portion of the hydraulic lash adjuster is retracted mechanically.

7. The method of claim 4 wherein retracting an inner portion of the deactivating hydraulic lash adjuster comprises collapsing diametrically opposed pins from an engaged position with an annular groove defined in the outer portion of the deactivating hydraulic lash adjuster.

8. A system for operating a rocker arm assembly in a cylinder deactivation mode, the system comprising:

a two-step variable valve lift rocker arm assembly operable in a (i) low-lift mode having a low-lift valve profile and a (ii) high-lift mode having a high-lift valve profile, wherein the rocker arm assembly comprises an inner arm, an outer arm that is pivotally coupled to the inner arm, and a latch assembly having a latch and wherein the latch is mechanically actuated between a first configuration in the high-lift mode to a second configuration in the low-lift mode;

a deactivating lash adjuster operable in a latched mode and an unlatched mode;

a controller that (i) selects operation of the rocker arm assembly in the cylinder deactivation mode, (ii) operates the rocker arm assembly in the low-lift mode based on the selection of the cylinder deactivation mode, and (iii) subsequent to operating the rocker arm assembly in the low-lift mode, operating the deactivating lash adjuster in the unlatched mode; and wherein a first amount of a total lost motion required for cylinder deactivation mode is accounted for by lost motion of the rocker arm assembly operating in the low-lift mode and a remainder amount of the total lost motion is accounted for by lost motion of the deactivating lash adjuster operating in the unlatched mode.

9. The system of claim 8 wherein the latch is engaged with one of the inner and outer arms such that the outer arm rotates with the inner arm in the high-lift mode.

10. The system of claim 8 wherein the latch is disengaged from one of the inner and outer arms such that one of the inner and outer arms rotates independently from the other of the inner and outer arms in the low-lift mode.

11. The system of claim 8 wherein the latch mechanically translates between the extended position and the retracted position by way of an auxiliary cam shaft that is rotated by a motor, the auxiliary cam shaft causing a selector cam lobe to compress a compliance spring and thereby translate the latch pin.

12. The system of claim 8 wherein the deactivating lash adjuster is a two-position lash adjuster that moves between a first position wherein the lash adjuster is locked and a second position where the lash adjuster is unlocked.

13. The system of claim 12 wherein the deactivating lash adjuster includes an inner portion that extends at least partially outwardly relative to an outer portion in the first position to a location where latch pins are biased outwardly by a biasing member to a position engaged to an annular notch defined in the outer portion.

* * * * *